United States Patent [19]

Zapart

[11] 4,100,702

[45] Jul. 18, 1978

[54] FAST GRIND FIXTURE

[76] Inventor: Bruno J. Zapart, 3624 N. Janssen St., Chicago, Ill. 60613

[21] Appl. No.: 803,087

[22] Filed: Jun. 3, 1977

[51] Int. Cl.[2] ..... B24B 41/04

[52] U.S. Cl. ..... 51/216 H; 33/174 S; 51/DIG. 33

[58] Field of Search ..... 33/174 S, 174 TC; 51/216 H, 216 ND, DIG. 31

[56] References Cited

U.S. PATENT DOCUMENTS

| | | | |
|---|---|---|---|
| 1,683,509 | 9/1928 | Wescott | 33/174 S |
| 2,365,436 | 12/1944 | Saucier | 51/DIG. 31 |
| 3,298,141 | 1/1967 | Daubitz | 51/216 H |

*Primary Examiner*—Harold D. Whitehead
*Attorney, Agent, or Firm*—Ralph R. Pittman

[57] ABSTRACT

An indexing fixture adapted for operation with an internally held collet-receiving work piece and having means for both indexed axial rotation and indexed axial tilting in a vertical plane has certain moving parts which may be adversely affected by grinding wheel dust shielded by other members less liable to damage. Also, adjustable means is provided for influencing certain elements to compensate for abrasive dust damage. A selectively positionable indexing dog enables the establishment of a rotary indexing position of an associated work piece along its radius or diameter.

8 Claims, 10 Drawing Figures

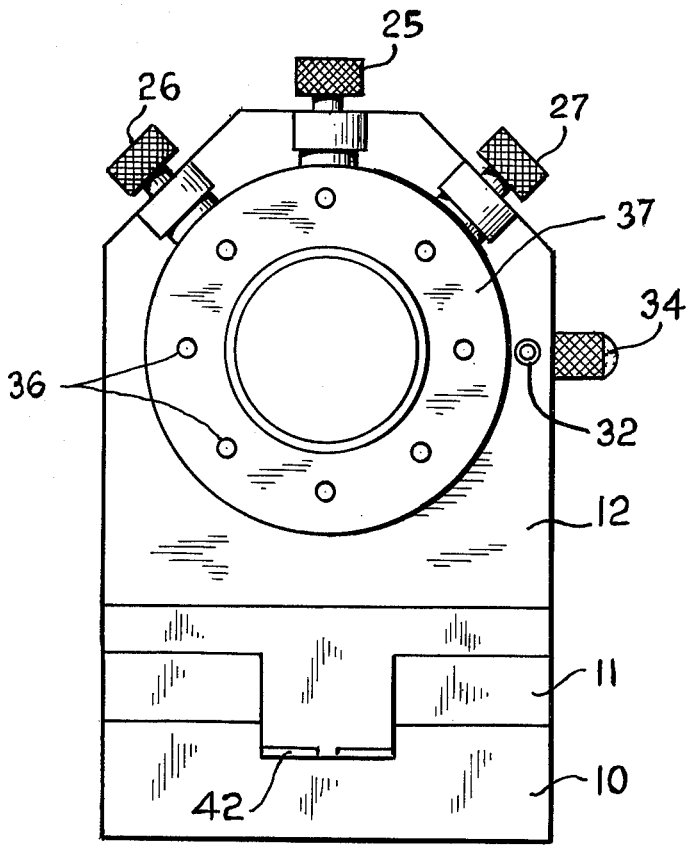
Fig. 4
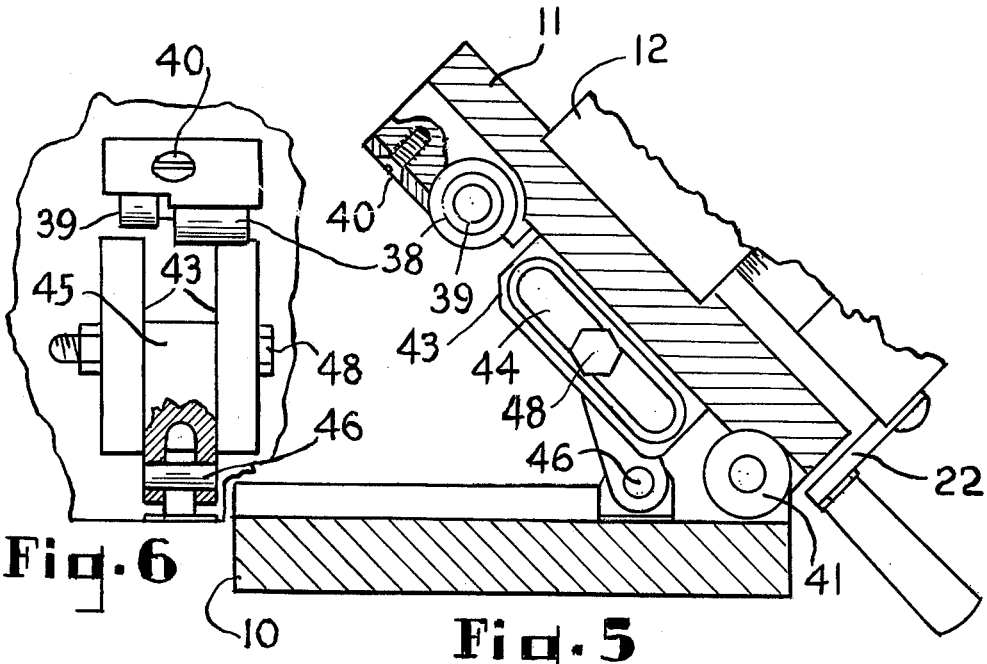
Fig. 6
Fig. 5

FAST GRIND FIXTURE

BACKGROUND OF THE INVENTION

Indexing work piece holders utilized in grinding work pieces to a desired shape necessarily embody movable members to enable the work piece to be either rotated about its axis or tilted in a vertical plane, or preferably both. A high degree of precision is often specified in grinding operations, and the quality of the work is largely dependent upon the integrity of close-fitting movable members, the quality rapidly deteriorating when the movable parts are coated by the fine particulates of the grinding wheel dust incident to the operation.

Work holder damage by abrasive dust has long been recognized, and progress has been made in developing structures less susceptible to, but far from completely free, of such damage. The invention herein describes an indexing fixture in which the deposit of abrasive dust upon its movable parts is made less likely by effectively shielding them by other less affected members of the structure.

The precise rotary setting of any indexing device is fundamentally a matter of selecting a desired angle of the indexing plate between two angularly spaced radii in units of degrees, minutes and seconds, the angle being often determined by the use of measuring blocks of a height equal to the sine of the desired angle.

The matter of indexing the rotary indexing plate precisely through the angle so determined has occasioned the development of a large number of indexing devices differing in structure. Obviously a high degree of accuracy may be realized by the use of closely circumferentially spacing a large number of holes peripherally spaced around the rotary indexing plate, using an indexing pin inserted into one of the holes to engage a measuring member of known height. Some prior art indexing devices are described as having over 300 such holes; it is apparent that any structure requiring the precise locating of each of a large number of indexing holes is an expensive article.

SUMMARY OF THE INVENTION

The work holder fixture described herein embodies structural relationships particularly directed to minimizing damage resulting from the presence of grinding wheel dust during precise grinding operations and additionally, for compensating for abrasive wear on certain members the integrity of which is essential to precision work. Specifically, an end play compensating structure associated with the indexing wheel provides for axial adjustment of the spindle and attached rotary indexing plate, and the sine plate rollers used in setting the tilt of the indexing plate in a vertical plane are structured to be rotatable as may be necessary to compensate for surface abrasion.

The tiltable sine plate which is swingably mounted on the lower base of the fixture has mounted along the central longitudinal portion of its underside the mechanism for holding the sine plate at a selected vertical angle, the mechanism being disposed in a recess in the lower base when only rotary angle grinding is being done, and is thus effectively shielded from grinding wheel dust.

For enabling a rotary angular movement of a work piece between two radii, the invention utilizes a rotary indexing plate having a peripheral circumferential groove into which is fitted and fastened, as required, one or more indexing dogs, each of which is engageable with a reciprocably axially movable detent. Preferably at least two dogs should be available, each being set at a predetermined radius, the rotary indexing plate associated with the work piece being rotatively movable through the angle separating the indexing dogs.

Only eight axially directed radially spaced holes, circumferentially spaced from one another by an angle of 45°, are required in the face of the rotary indexing plate or spindle flange, and indexing pin in a selected hole being used with well known measuring parallels or blocks to determine the desired angular position of the indexing dogs. For angular adjustments of 5° to 10° intervals, indexers cooperating with a 36 tooth indexing wheel may be used, in a manner well known in the toolmaker art.

BRIEF DESCRIPTION OF THE DRAWING

FIG. 4 is a front elevational view of the invention;

FIG. 5 illustrates the vertical angle adjusting mechanism, being a side elevation shown partly in section;

FIG. 6 is a fragmentary view of the connecting rod and associated elements of the vertical angle adjusting structure, partly in section;

DESCRIPTION OF THE PREFERRED EMBODIMENT

Figure 1:
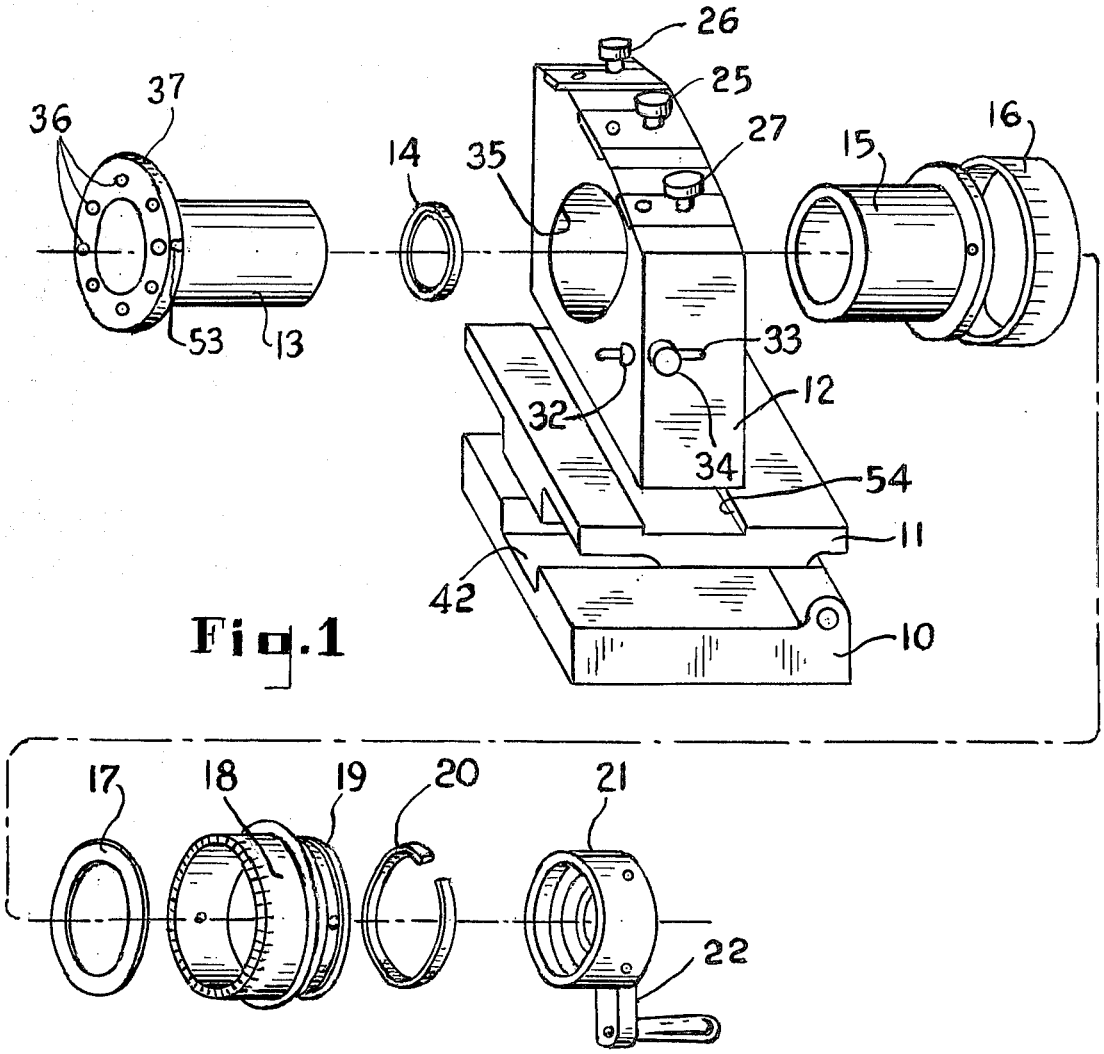
FIG. 1 of the drawing is an isometric partially exploded view of the principal structural elements of the invention.
Figure 7:
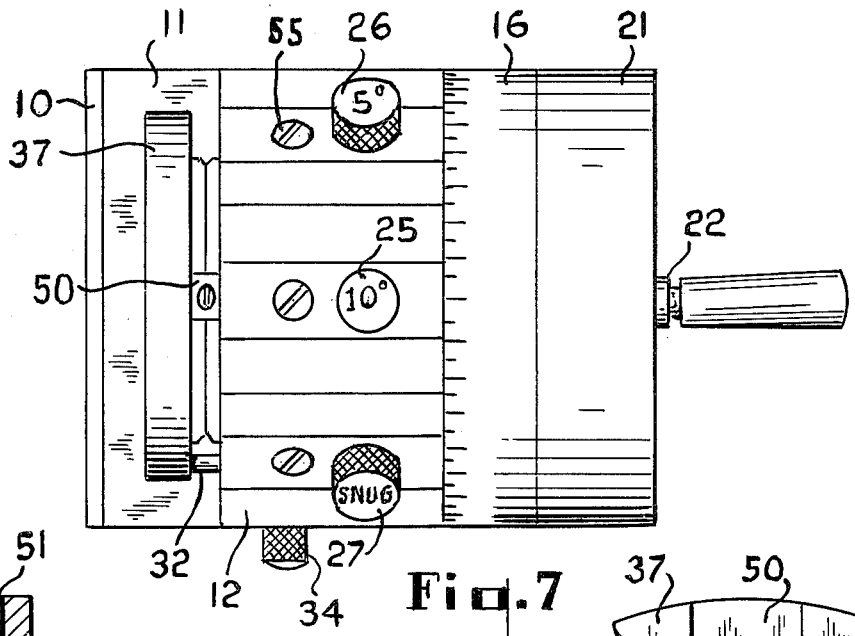
FIG. 7 is a plan view of the invention.
Figure 9:
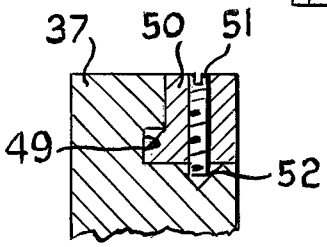
FIG. 9 is an enlarged fragmentary view illustrating the construction used for enabling selective peripheral attachment of the detent-engaging indexing dog to the radial flange forming the rotary indexing plate of the spindle.
Figure 10:
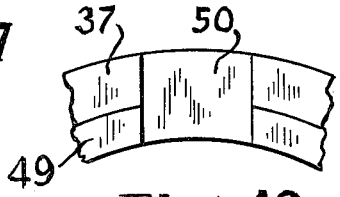
FIG. 10 is another view of the just-mentioned construction as seen looking forward from the rear of the indexing dog.
Figure 8:
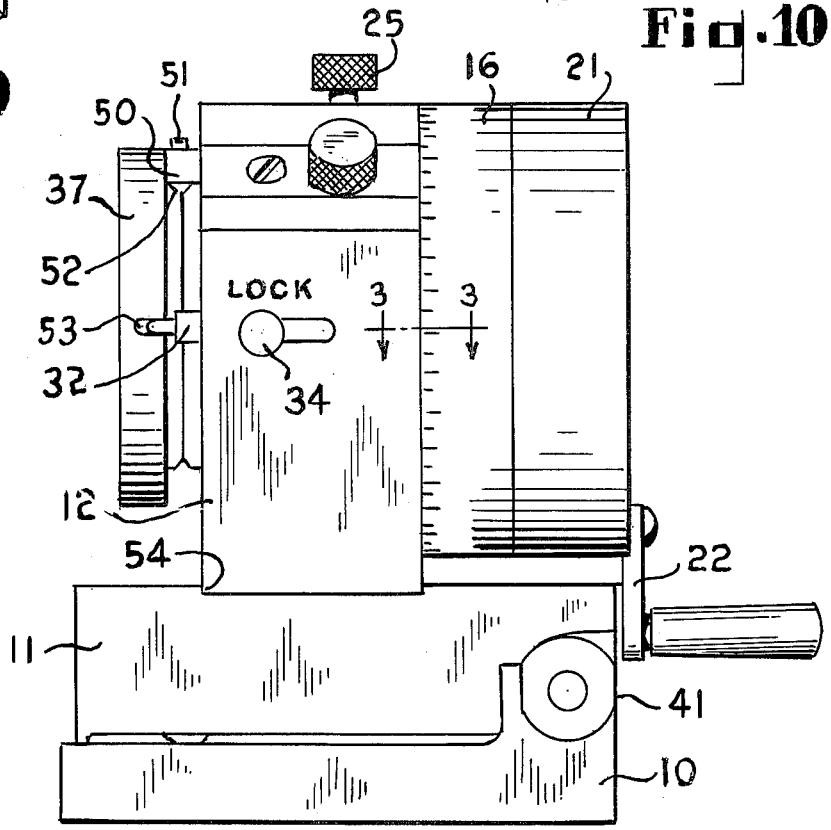
FIG. 8 is a side elevational view of the invention.

The principal components of the invention appear in the exploded view at FIG. 1 of the drawing; FIGS. 4, 7 and 8 are respectively front elevation, plan and side elevational views of the assembled invention and FIGS. 5, 6, 9, and 10 illustrate in detail certain novel structural relationships embodied in the invention.

In common with the construction depicted in many wellknown work holders, the invention includes a lower base 10, upon which is swingably mounted an base 11, the latter being sometimes referred to as a sine plate. A shallow rectangular recess 54 extends transversely across an intermediate portion of the topside of the upper base 11, into which is nested and fixedly secured the housing 12.

A cylindrically shaped bore 35 extends longitudinally through the housing 12, into which is tightly pressed from the rearward end of the housing 12 the radially flanged cylindrical tubular member 15. The axis of the bore 35 of the housing is parallel to the planar lower surface of the lower base 10, as is the axis of the parallel-extending opening through the member 15.

From the other or forward end of the housing 12 the radially flanged hollow cylindrical spindle 13 is slip-fitted into the bore of the tubular member 15 for rotation therein, the flanged end or rotary indexing plate 37 projecting forwardly from the forward face of the housing 12 and the the unflanged end projecting rearwardly beyond the rearward surface of the radial flange 23. A dust-shield washer 14, preferably of a felt material, is placed around the rearward end portion of the spindle 13 before it is inserted in the housing.

The toothed indexing wheel 18 is concentrically secured to the rearwardly projecting portion of the spindle 13, and the annular indicating ring member 16 is tightly pressed over and circumferentially encloses the indexing wheel 18. The forwardly projecting teeth (FIG. 2) of the indexing wheel 18 are spaced at 10° intervals, and a series of graduation marks along the surface of the indicating ring member 16 correspond to the angular separation of the index wheel teeth 47 to indicate the angular movement thereof.

The indexing wheel 18 has a rearwardly directed coextensive integral portion 19, in which an inwardly extending groove is formed to provide a circular keyway 31 (FIG. 3) in which the resiliently expansible arcuate key may be received. The internally threaded manipulating ring 21 has a complementary outwardly extending groove, and the presence of portions of the key 20 in each of the grooves securely attaches the manipulating ring to the index wheel, while at the same time permitting the manipulating ring to rotate freely thereabout, as when turned by the hnad crank 22.

As shown in FIGS. 4 and 7, the top surface of the housing 12 is divided into three planar portions of equal area, the longitudinal center line of the topmost portion being positioned vertically over the axis of the cylindrical opening through the housing, and the longitudinal center line of each of the other portions lying in a plane extending radially from the axis at an angle of 45° with respect to a vertical radial plane.

The number of equally spaced teeth of the indexing wheel is the same as that described in my U.S. Pat. No. 3887202; i.e., 36 in number at 10° intervals, so that indexers located on the center lines of the top surface portions and movable to engage the indexing wheel at interspaces between selected teeth will enable either 5° or 10° angular movement of the indexing wheel, as described in the above-cited patent. At FIG. 7 the 10° indexer is indicated by the numeral 25 and the 5° indexer by the numeral 26. The indexer at the numeral 27 simply engages the face of the wheel to frictionally resist its movement.

Figure 2:
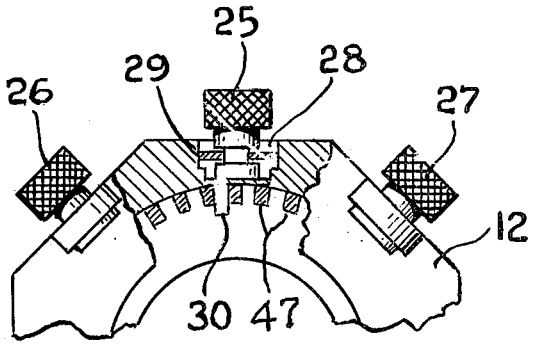
FIG. 2 is a fragmentary elevation, partly in section, showing an indexer in position between adjoining teeth of the indexing wheel.

The indexer structure is illustrated in detail in FIG. 2. The indexer 25 is mounted on an elongate rectangular plate 28, which is fitted in a complementary recess in the top of the housing 12. The inwardly extending stem of the indexer is provided with a groove extending around the portion passing within the mounting plate, and a pair of diametrically opposed retaining screws 29 extend therein. At the inner end of the indexer stem an eccentric downwardly directed portion 30 is disposed to turnably move into an adjacent interspace in the toothed indexing wheel. The indexer mounting plates are normally fastened to the housing 12 by the fastener 55, the removal of which permits access to the entire indexer assembly for cleaning and repair.

Figure 3:
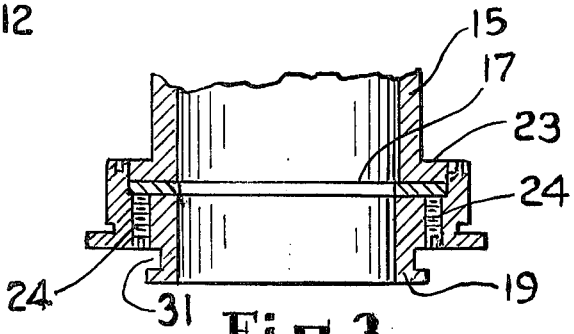
FIG. 3 is a fragmentary section showing the end play adjustment structure, taken along the transverse plane indicated by the line 3—3 of FIG. 8.

The end play compensation structure incorporated in the invention is shown at FIG. 3. An end play washer 17 is interposed between the flanged end of the tubular member 15 and the indexing wheel 18, in position to be axially urged forwardly by a movement of the adjustment screws 24.

Referring to FIGS. 7 and 8, the radial flange or indexing plate 37 of the spindle 13 projects slightly forward beyond the forward surface of the housing 12, the rearward surface of the flange 37 is undercut (FIGS. 9 and 10) to provide an annular forwardly extending recess 49, and a radially directed circumferential V-shaped groove 52 is provided adjacent to the front wall of the housing. The circumferentially movable L-shaped indexing dog is removably secured to the flange 37, one arm of the L-shaped indexing dog being slip-fitted into the grooved recess 49. A set screw 51 extends radially inward through the other arm of the indexing dog, engaging the inner surface of the V-shaped groove 52 and thereby rigidly fixing the indexing dog to the rotary indexing plate 37.

The flange 37 of the spindle is also provided with a forwardly directed peripheral detent-receiving slot 53, into which the detent 32 may be slidably inserted for positively locking the spindle to the housing.

The detent 32 is normally nested in an axial opening in the housing 12, and is axially and reciprocably movable along the guide slot 33 by manipulation of the actuating knob 34. The detent may also be seated in the slot 53, or withdrawn fron the slot and positioned in the rotary path of the indexing dog 50.

A desired position of the rotary indexing plate or flange 37 to effect a corresponding position of an associated work piece may be established by inserting an indexing pin in one of the eight axially extending holes 36 in the face of the flange 37. These holes are equally spaced both radially and angularly, the angular separation being 45°, and are adapted for receiving slip-fitted indexing pins engageable with any suitable angle setting measuring apparatus.

The centrally disposed mechanism for axially tilting the longitudinal axis of the spindle 13 is shown in FIGS. 5 and 6. The swingable upper base 12, sometimes referred to as a sine-plate base, is shown after having been swung upwardly about the pivotal mounting 41, having moved out of the central longitudinally extending recess 42 in the lower base 10. The upper base 11 is formed with a pair of linearly extending downwardly directed parallel projections 43, each of which is provided with a coextensive slotted opening 44. A connecting rod 45 is slidably movable between the slots 44, moving when the upper base is tilted about the fixed lower pivotal mounting 46 and about the slidably movable pivotal mounting 48 at the upper or forward end of the connecting rod. The upper base is lockable in the selected angular position by adjusting the tension on the bolted connection at the upper slidably movable pivotal mounting.

At the underside of the forward end portion of the upper base 11 and partially recessed therein are mounted the large revoluble sine plate roller 38 and the small sine plate roller 39. Normally the rollers are fixed in place by the screw 40, but may be rotated as required to compensate for out-of-round wear.

The indexing fixture described herein is intended for use with a collet in threaded engagement with the manipulating ring 21, or with some combination of chucks or V-blocks. The work piece held may be indexed as may be most convenient by (a) the 5 to 10 degree indexers, (b) a setting block engaged with an indexing pin inserted axially in the face of the spindle flange, (c)

appropriately positioning one or more of the selectively positionable indexing dogs or (d) positively locking the spindle with the detent 32. Parallels, micrometers, calibrated blocks or other measuring apparatus may be used to establish the rotary angular or tilt setting desired, the use of such equipment being well known in the tool making art.

What is claimed is:

1. An indexing fixture adapted for operation with a workholding collet, said fixture comprising;

a rigid upstanding housing generally rectangular in horizontal section, a cylindrical bore extending longitudinally through said housing;

a fixed cylindrical hollow open-ended tubular member snugly fitted coaxially in the bore of said housing and an outwardly directed radial rearward flange disposed at one end of said fixed member, said rearward flange interfacially engaging the rearward wall of said housing;

a revoluble hollow open-ended cylindrical spindle slip-fitted in said fixed tubular member and projecting rearwardly therefrom, and an outwardly directed radial forward flange at the forward end of said spindle, said flange being positioned forwardly beyond the forward wall of said housing;

a toothed indexing wheel rigidly secured to the rearwardly projecting portion of said spindle and indicating means associated with the indexing wheel effective to designate the rotary angular position of said spindle;

a collet-receiving internally threaded manipulating ring loosely keyed to said indexing wheel and freely rotatable thereon;

at least one rotatable indexer extending downwardly through the top of said housing and having a portion movable into the rotary path of said indexing wheel;

a detent reciprocably slidable into and from said housing, said detent being disposed adjacent to said forward flange and selectively movable to engagement therewith;

at least one detent-engaging dog mounted on said forward flange adjacent to said housing; and selectively positionable fastening means removably securing said dog to said flange along any chosen diameter of the forward flange.

2. The indexing fixture as claimed in claim 1, in which an annular spacer member in the form of a flat washer is interposed between said rearward flange and said indexing wheel and adjustment means carried by said indexing wheel for fixing the interfacial contact pressure between the forward surface of said washer and the rearward surface of said rearward flange.

3. The indexing fixture as set forth in claim 1, wherein said detent-engaging dog is L-shaped, a forwardly directed undercut annular recess extends circumferentially along the rearward side of the forward flange and a V-shaped groove coextensive with said annular recess extends around the forwardly projecting portion of the spindle, one leg of the L-shaped dog being fitted into said recess and the other leg extending upwardly over said V-shaped groove, a threaded opening extending radially through said other leg, and a fastener threadedly engaging said other leg and movable therealong into said V-shape groove.

4. In an indexing fixture adapted for operation with a collet, said fixture having a housing rectangular in section and upstanding forward and rearward planar walls, a cylindrical bore passing longitudinally through said housing, a fixed cylindrical hollow open-ended tubular member snugly fitted coaxially into the bore of said housing and a hollow revoluble open-ended cylindrical spindle slip-fitted coaxially into said fixed tubular member;

the improvement wherein the top of said housing comprises three contiguous rectangular planar portions of equal area including a topmost horizontal portion the longitudinal centerline of which lies in a vertical plane passing through the longitudinal axis of said spindle and a pair of coextensive downwardly sloping portions each of which is normal to a plane passing through said axis at an angle displaced 45° from said vertical plane;

a recess rectangular in section extending longitudinally through each of the top portions and an indexer mounting plate removably nesting in each of said recesses;

an indexer rotatably mounted on each of said plates and passing downwardly therethrough;

and a toothed indexing wheel fixed to said spindle in the path of movement of each of said indexers.

5. In an indexing fixture having a collet-receiving spindle, means for rotatively moving said spindle to a selective rotary angular position and supporting base means tiltable to a selected angular position in a vertical plane, said base means including a lower base having a planar underside and an upper sine plate pivotally mounted on said lower base, the improvement comprising:

the provision of a centrally positioned rectangular downwardly directed recess extending longitudinally along said lower base from one end to the other;

holding means effective to retain said sine plate in a selected angular position with respect to said planar underside of said lower base;

said holding means including a pair of longitudinally extending transversely spaced downwardly directed projections positioned along a medial portion of the underside of said sine plate, an opposed slotted opening extending linearly along each of said projections, a pivotally mounted connecting rod disposed between the projections and movable therealong, said connecting rod joining said sine plate to said lower base and an adjustable fastener movable with said connecting rod extending transversely through said slotted openings for securing said connecting rod to the slotted projections;

at least one transversely extending revoluble cylindrical sine plate roller secured to the forward end portion of said sine plate, a substantially semicylindrical cavity extending transversely within said forward end portion from the underside thereof, said roller being rotatively slip fitted into said cavity in interfacial engagement with the interior surface of said cavity.

6. The indexing fixture according to claim 5, in which an additional substantially semicylindrical cavity extends within said forward end portion of said sine plate coaxially with the first named cavity from the underside thereof, said additional cavity differing in cross section with respect to said first named cavity, there being an additional roller rotatively slip fitted in interfacial engagement with the interior surface of said additional cavity.

7. The indexing fixture as claimed in claim 5, wherein releasable holding means mounted on said sine plate normally restrains rotary movement of said roller.

8. The indexing fixture as claimed in claim 6, wherein a single releasable holding means on said sine plate normally restrains rotary movement of both of said rollers.

* * * * *